US009739150B2

(12) United States Patent
Remy

(10) Patent No.: US 9,739,150 B2
(45) Date of Patent: Aug. 22, 2017

(54) ATTACHING THE BLADES OF AN AXIAL TURBOCOMPRESSOR TO THE COMPRESSOR DRUM

(71) Applicant: Techspace Aero S.A., Herstal (Milmort) (BE)

(72) Inventor: Christophe Remy, Fexhe-Le-Haut-Clocher (BE)

(73) Assignee: Safran Aero Boosters SA, Herstal (Milmort) (BE)

( * ) Notice: Subject to any disclaimer, the term of this patent is extended or adjusted under 35 U.S.C. 154(b) by 667 days.

(21) Appl. No.: 14/168,530

(22) Filed: Jan. 30, 2014

(65) Prior Publication Data

US 2014/0219803 A1 Aug. 7, 2014

(30) Foreign Application Priority Data

Feb. 4, 2013 (EP) ..... 13153799

(51) Int. Cl.

| | |
|---|---|
| ***F01D 5/06*** | (2006.01) |
| ***F01D 5/30*** | (2006.01) |
| *F01D 5/02* | (2006.01) |
| *F01D 11/02* | (2006.01) |
| *F01D 11/12* | (2006.01) |

(52) U.S. Cl.

CPC ..... *F01D 5/066* (2013.01); *F01D 5/3046* (2013.01); *F01D 5/02* (2013.01); *F01D 5/06* (2013.01); *F01D 11/02* (2013.01); *F01D 11/122* (2013.01); *F05D 2250/38* (2013.01)

(58) Field of Classification Search

CPC ..... F01D 5/066; F01D 5/3046; F01D 5/06; F01D 5/02; F01D 11/02; F01D 11/122; F05D 2250/38

See application file for complete search history.

(56) References Cited

U.S. PATENT DOCUMENTS

2005/0254950 A1* 11/2005 Mons ..... F01D 5/06 416/201 R
2009/0180886 A1* 7/2009 Derclaye ..... F01D 5/3038 416/215

FOREIGN PATENT DOCUMENTS

| | | | | |
|---|---|---|---|---|
| DE | EP 0422433 A1 * | 4/1991 | ..... | F01D 5/3046 |
| EP | 0422433 A1 | 4/1991 | | |
| EP | 1406019 A1 | 4/2004 | | |
| EP | 1626163 A2 | 2/2006 | | |
| EP | 2075417 A1 | 7/2009 | | |
| GB | 2001398 A * | 1/1979 | ..... | F01D 5/3046 |

OTHER PUBLICATIONS

European Search Report dated Jun. 12, 2013 for EP 13153799.5.

* cited by examiner

*Primary Examiner* — Ryan J Walters
(74) *Attorney, Agent, or Firm* — James E. Walton

(57) ABSTRACT

The present application relates to the compressor drum of an axial turbomachine. The drum includes a wall of revolution that forms a hollow body. The wall includes two annular retaining surfaces of the blades which mate with corresponding retaining surfaces of the said blades. These surfaces are generally directed away from one another to form a profile which diverges as its distance radially from the outer surface of the wall increases. The retaining surfaces of the drum may be formed on an outer annular body or on inclined annular flanges.

12 Claims, 3 Drawing Sheets

ATTACHING THE BLADES OF AN AXIAL TURBOCOMPRESSOR TO THE COMPRESSOR DRUM

This application claims priority under 35 U.S.C. §119 to European Patent Application No. 13153799.5, filed 4 Feb. 2013, which is incorporated herein by reference for all purposes.

BACKGROUND

1. Field of the Application

The subject application relates to a bladed drum of an axial compressor. More particularly, the subject application relates to a drum on which the rotor blades are attached through positive material contact. The subject application also relates to a turbomachine fitted with such a drum.

2. Description of Related Art

An axial turbomachine compressor preferably has several compression stages. Each compression stage comprises an annular row of rotor blades and an annular row of stator blades. A compressor rotor may be formed of a drum with an axially symmetric wall, which creates a lightweight and economical one-piece element.

A drum has a generally annular thin wall to which the rotor blades are attached directly. Several solutions for achieving that are possible. The blades can be welded into apertures in the drum wall or the blade roots can be inserted into axial grooves cut into the drum.

Alternatively, the drum can be provided with annular recesses in which there are mounting surfaces. The rotor blades have corresponding mounting surfaces enabling them to be clamped into the recesses.

Patent EP 2075417 A1 discloses a rotor drum of an axial turbomachine compressor. The drum has a symmetrical wall and annular recesses. The latter open radially outwards and have constrictions in the same direction. The blades are clamped within the annular recesses. For this purpose they have feet whose profiles correspond to the recesses and are inserted into them. They are thus retained radially. The existence of the recesses requires a large mass of material, which makes the drum heavier. Also, this material represents a cost. In addition, an annular recess forms a material discontinuity in the drum wall as it extends radially to the drum wall. It reduces its stiffness, resulting in increased flexing when the turbomachine is operating. The blade roots are pulled outwards due to the centrifugal force. Because of their shape, they tend to separate from the inner edges of the annular recesses, which further distorts the drum. Each annular recess has clamping surfaces which have to be machined. Because of the closed nature of the recesses, the clamping surfaces are relatively inaccessible, making machining complicated.

Although great strides have been made in the area of bladed drums for axial compressors, many shortcomings remain.

DETAILED DESCRIPTION OF THE PREFERRED EMBODIMENT

Figure 1:
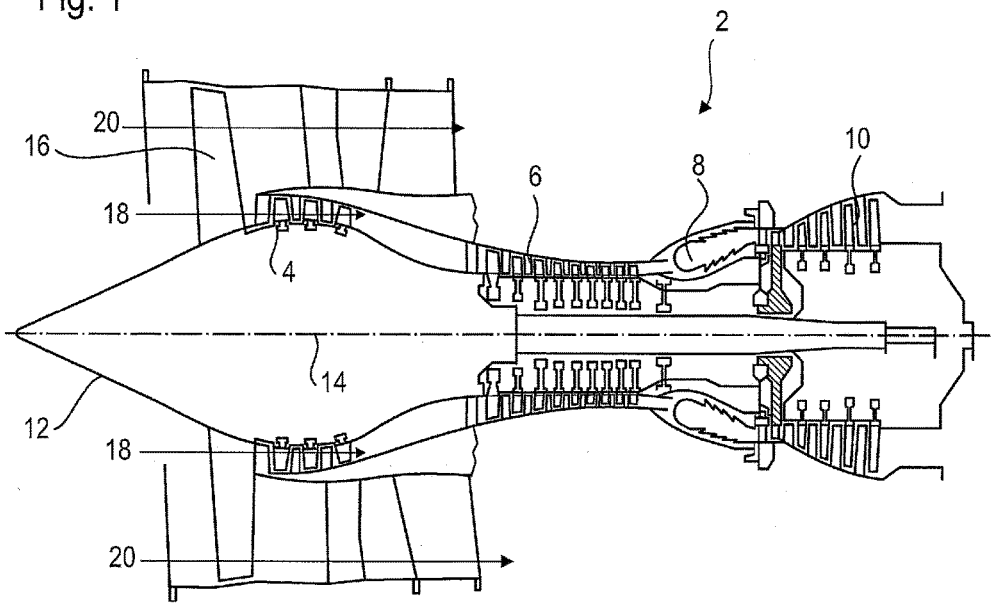
FIG. 1 shows an axial turbomachine in accordance with the subject application.

The present application aims to solve at least one of the problems presented by the prior art. The present application also aims to facilitate the machining of the clamping surfaces of the drum. The present application also aims to lighten the bladed drum of an axial compressor. The present application also aims to stiffen a bladed drum of an axial compressor.

The present application relates to a rotor drum on an axial turbomachine, comprising a wall of revolution around the axis of rotation of the rotor that forms a hollow body and comprising on its outer surface two annular blade row retaining surfaces; wherein the two retaining surfaces of the drum wall are generally directed away from one another to form a profile which widens the further it is radially from the outer surface of the wall. The wall may be materially continuous between the clamping surfaces.

The drum may be substantially free of material on the inside wall. It may thus be free of discs or annular discs.

According to an advantageous embodiment of the present application, the profile of each of the two retaining surfaces forms an average angle of between 30° and 60° with the axis of rotation, and/or the profiles of the said surfaces form an average angle between them of between 60° and 120°.

According to an advantageous embodiment of the present application, the wall defines the shape of the drum, preferably from its front end to its rear end.

According to an advantageous embodiment of the present application, the drum wall has one or more annular ribs upstream and downstream respectively of the two retaining surfaces, the said ribs being configured to mate with annular abradable layers of material, the wall extending substantially in a straight line along the two retaining surfaces between the said upstream and downstream ribs.

According to an advantageous embodiment of the present application, the two retaining surfaces are generally raised radially relative to the adjacent wall.

The radial height of the retaining surfaces is between 1% and 10% of the mean radius of the drum wall where they are located, preferably between 1% and 5%, more preferably between 1% and 3%. This feature of the present application is to reduce any radial interference with the clamping surfaces, the fixing brackets, the annular body or any associated flanges.

According to an advantageous embodiment of the present application, a segment of the two annular retaining surfaces includes a notch for mounting the blades on one of the two surfaces, so as to allow the blades to be assembled by a locking movement of the unnotched retaining surface, followed by tilting the platform to slide into the notch.

According to an advantageous embodiment of the present application, the retaining surfaces are formed by two annular flanges projecting from the outer surface of the wall, the said flanges being inclined opposite to one another relative to a direction perpendicular to the axis of rotation.

According to an advantageous embodiment of the present application, the two flanges are located on the wall, separated from one another, the said separation being preferably greater than 10 mm.

According to an advantageous embodiment of the present application, the drum comprises at least one annular body on the outer surface of the wall forming the retaining surfaces. The annular body can have a generally trapezoidal profile, whose parallel sides extend generally along the axis of rotation of the rotor, the smaller of these sides being on the inside.

According to an advantageous embodiment of the present application, the annular body comprises an annular groove open on the outside radially, designed to hold a seal, preferably in the shape of a toroid, designed to be pressed against the blade platforms by centrifugal force during rotation of the drum.

According to an advantageous embodiment of the present application, the drum includes the blade row, the said blades each comprising a platform with two abutment surfaces designed to mate with the retaining surfaces on the wall.

According to an advantageous embodiment of the present application, the blade platform has a cavity open towards the drum wall and forming the abutment surfaces, the bottom of the cavity forming a radial abutment surface facing the inside of the drum.

According to an advantageous embodiment of the present application, the two blade platform contact surfaces are located mainly to the right of the leading and trailing edges, respectively.

The present application relates to a turbomachine comprising a turbine rotor or compressor, preferably low-pressure, wherein the rotor comprises a drum according to the present application, and preferably wherein the drum comprises a plurality of sets of retaining surfaces, each set corresponding to a blade row.

The present application simplifies machining of a turbomachine drum. Clearance around the retaining surfaces is increased, which simplifies manufacturing operations and the related metrology.

The present application enables functional elements such as the retaining surfaces and the lip seals to be positioned on the same side of wall. When the drum is machined from a blank, the volume to be machined from the interior is reduced. This configuration provides a smooth inner surface, which facilitates the insertion of interior supports when restarting cutting.

The present application serves to stiffen the drum. The profile of the wall has a continuous curvature and limits changes in the radii. Variations in the thickness of the profile are limited, which improves the durability of the drum.

The present application also improves the stability of the blade attachments on the rotor. They come into contact with surfaces which may easily be separated or remote from one another, this without increasing the amount of material needed for the drum and without increasing its weight.

In the following description, the terms inner and outer refer to a position relative to the axis of rotation of an axial turbomachine.

FIG. 1 shows an axial turbomachine. In this case it is a double-flow turbojet. The turbojet 2 comprises a first compression stage, a so-called low-pressure compressor 4, a second compression stage, a so-called high pressure compressor 6, a combustion chamber 8 and one or more turbine stages 10. In operation, the mechanical power of the turbine 10 is transmitted through the central shaft to the rotor 12 and drives the two compressors 4 and 6. Reduction mechanisms may increase the speed of rotation transmitted to the compressors. Alternatively, the different turbine stages can each be connected to compressor stages through concentric shafts. The compressor comprises several rotor blade rows associated with stator blade rows. The rotation of the rotor 12 around its axis of rotation 14 thus generates a flow of air, gradually compressing it up to the inlet of the combustion chamber 10.

An inlet fan, commonly designated a fan 16, is coupled to the rotor 12 and generates an airflow which is divided into a primary flow 18 passing through the various above-mentioned levels of the turbomachine, and a secondary flow 20 passing through an annular conduit (shown in part) along the length of the machine and then rejoins the main flow at the turbine outlet. The primary flow 18 and secondary flow 20 are annular flows and are channelled through the housing of the turbomachine. To this end, the housing has cylindrical walls or shells that can be internal or external.

Figure 2:
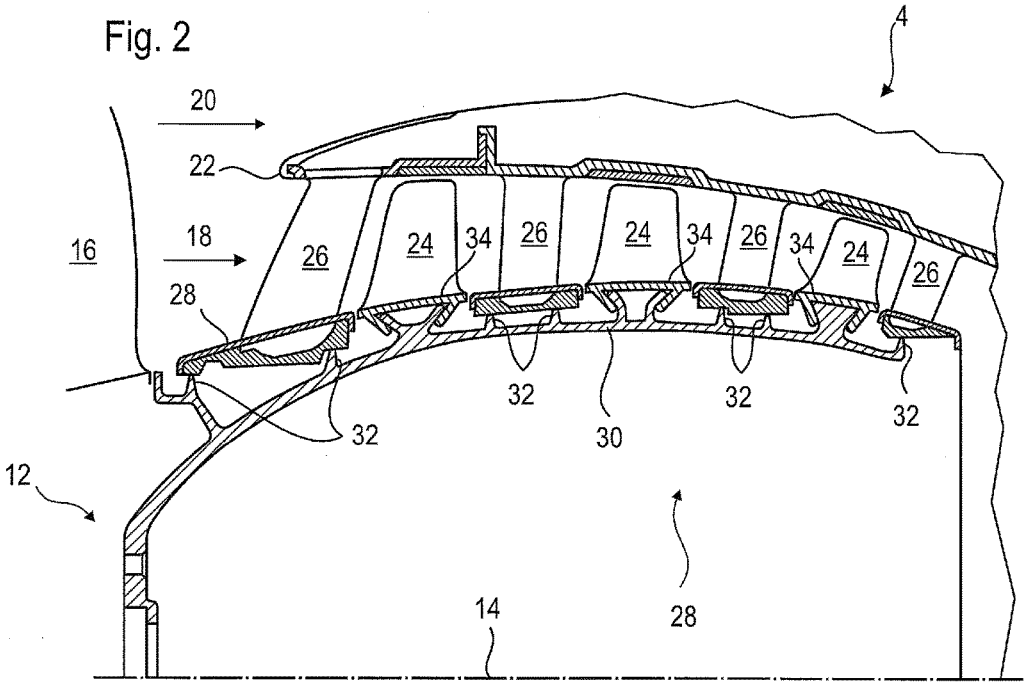
FIG. 2 is a sectional view of a turbomachine compressor in accordance with the subject application.

FIG. 2 is a sectional view of a low-pressure compressor 4 of an axial turbomachine 2 such as that of FIG. 1. Part of the turbofan 18 can be seen, as can the splitter nose 22 between the primary 18 and secondary 20 airflows. The rotor 12 comprises several rows of rotor blades 24, three rows in the particular case of FIG. 2.

The low-pressure compressor 4 includes several stators, for example four, each containing a row of stator blades 26. Stators are associated with the fan 16 or a row of rotor blades 24 for straightening the airflow so as to convert the velocity pressure of the stream into pressure.

The rotor blades 24 spread out substantially radially from the rotor 12. They are regularly spaced out from each other, and have the same angular orientation to the stream. Advantageously, these rotor blades 24 are identical. Optionally, the spacing between the blades can vary locally as can their angular orientation. Some blades in a row may be different from the rest.

The rotor 12 comprises a drum 28. The drum 28 has a wall 30 with a profile of revolution about the axis of rotation 14. The profile of revolution of the wall may have a generally continuous curvature. Radially it follows the sectional variation of the primary flow's inner surface. The wall 30 is basically thin. Its thickness is generally constant. Its thickness is less than 10.00 mm, preferably less than 5.00 mm, more preferably less than 2.00 mm. The wall 30 forms a hollow body which defines a cavity with a cylindrical or ogival shape. The drum 28 and/or the rotor blades 24 are made of metallic material, preferably titanium. They are each formed integrally.

The drum 28 includes annular ribs 32 or lip seals. They form annular strips which extend radially. They are designed to mate abrasively with annular layers of abradable material so as to provide a seal. Generally, one abradable layer 32 mates with two ribs. When the compressor is in operation, the rotor 12 may be deformed. It may, for example, expand or increase in diameter under the effect of centrifugal force. These deformations may be apparent on the wall 30.

The rotor 12 comprises annular retaining surfaces. The rotor blades 24 include retaining surfaces which mate with corresponding retaining surfaces on the drum, enabling the rotor blades to be fixed there. The rotor blades 24 have lower platforms 34, located opposite the rotor 12. The clamping surfaces are located between the rotor 12 and the lower platform 34.

Figure 3:
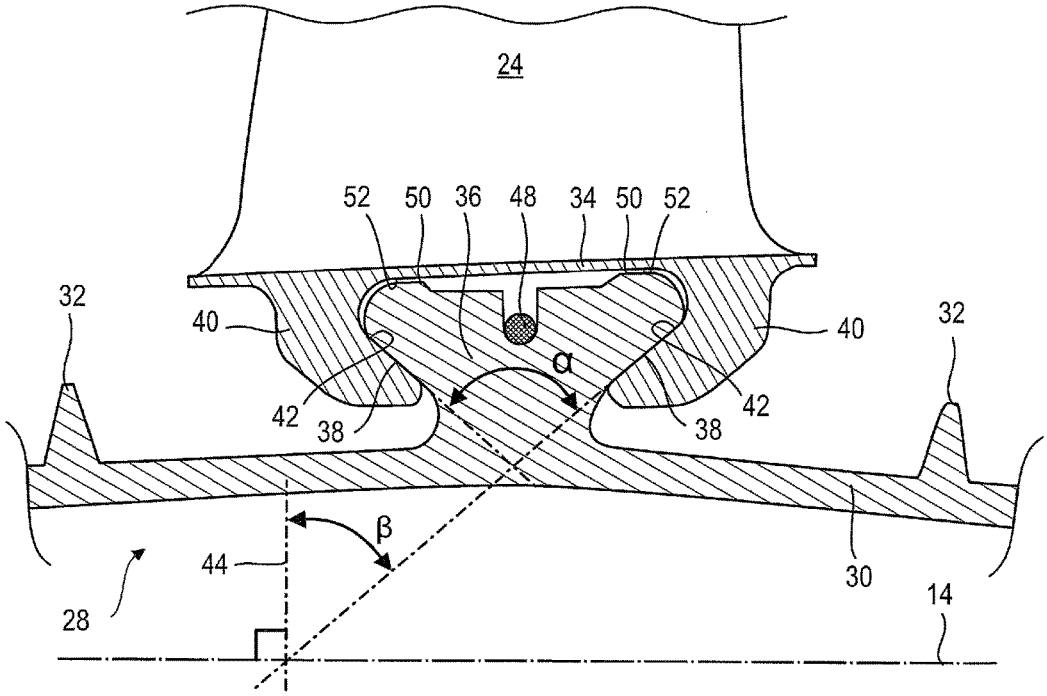
FIG. 3 illustrates a drum in accordance with a first embodiment of the subject application.

FIG. 3 illustrates a drum in accordance with a first embodiment of the present application.

The drum 28 comprises an annular body 36 on its outer surface. The latter has a generally trapezoidal profile whose parallel sides are substantially parallel to the axis of rotation 14, the other two inclined sides extending substantially radially. The inclined sides of the trapezoidal profile generate by rotation a set of two annular retaining surfaces 38 about the rotational axis 14. The drum 28 may have several sets of such retaining surfaces. Each set of retaining surfaces 38 is separated from adjacent sets by ribs 32.

The radial thickness of the annular body 36 is greater than 5.00 mm, preferably greater than 10.00 mm, more preferably greater than 20.00 mm. The annular body 36 forms an outer ring that helps strengthen and stiffen the drum 28. This reduces the deformation of the drum 28 arising from the centrifugal force. The annular body 36 enables the inner annular reinforcements or ribs on the drum to be replaced. A drum is generally machined by turning a drum-shaped blank whose walls are thicker than those of the finished drum. Radially, the blank must be thick enough to provide for outer retaining surfaces and interior ribs. All this leads to significant machining. Because the annular body 36 is located on the same side as the retaining surfaces 38, the blank can be much thinner with correspondingly less machining.

The rotor blade 24 includes fixing lugs 40 extending radially and axially under its lower platform 34. The fixing lugs 40 are inclined toward one another. The corresponding retaining surfaces 42 are located on the inner surfaces of the fixing lugs 40. The corresponding retaining surfaces 42 are opposite one another.

The retaining surfaces 38 and corresponding retaining surfaces 42 match. They mate over most of their length. They may be tapered. They are designed to mate by locking so as to fix the rotor blade 24 on the drum 28. They form a dovetailed joint. The flared section of the corresponding retaining surfaces 42, together with the section defined by the tapered retaining surfaces 38 of the drum enable the blade 24 to be retained radially against the drum 28.

The profiles of revolution of the retaining surfaces 38 and 42 are inclined relative to the perpendicular 44 to the axis of rotation 14 at an angle $\beta$ which is between 10° and 80°, preferably between 30° and 60° inclusive.

The profiles of the retaining surfaces 38 and 42 are inclined with respect to one another at an angle $\alpha$. The angle $\alpha$ is between 60° and 120°. The smaller the angle $\alpha$, the less the centrifugal force tends to separate the fixing lugs 40 while the turbomachine is in operation.

The retaining surfaces 38 are substantially raised radially relative to the wall 30 of the drum 28. The lip seals 32 are axially separated. The drum 28 is axially free of the surface that could form an obstacle to the retaining surfaces 38 by more than 5.00 mm, preferably more than 15.00 mm, more preferably more than 30.00 mm. The retaining surfaces 38 are thus easily accessible for machining, for example for roughing and finishing.

The wall 30 of the drum 28 may extend substantially in a straight line at the retaining surfaces 38, preferably between the ribs 32 located upstream and downstream. This feature helps maintain the rigidity of the drum 28. In particular, it is more resistant to axial compression. One consequence is that the wall 30 may be made thinner. The profile of the inner surface of the wall 30 may be generally straight or may be substantially curved. This aspect reduces stress concentration and improves the life of the drum.

The annular body 36 has an annular groove opening radially outwards. The rotor 12 includes an O-ring 48 housed within this annular groove. The inside radius of the O-ring 48 is less than or equal to the radius of the bottom of the groove, the radii being measured from the axis of rotation 14. The O-ring 48 is essentially elastic. Under the effect of the centrifugal force which arises during operation of the turbomachine, the O-ring 48 is pressed against the inner surface of the lower platform 34 of the rotor blade 24. It thus provides a seal between the upstream and downstream sides of the blade 24.

The annular body 36 includes radial abutment surfaces 50 located upstream and downstream. They may be substantially cylindrical and are oriented radially outwards. The rotor blade 24 has corresponding abutment surfaces 52 which are designed to mate with the abutment surfaces 50 of the drum. The abutment surfaces 52 are arranged opposite the abutment surfaces 50 of the drum. During operation of the turbomachine, these surfaces 50 and 52 are held apart from each other. Centrifugal force holds them apart. They are capable of coming into contact with one another or at least being close when changing the operating condition of the turbomachine. These surfaces 50 and 52 reduce or block any upstream or downstream tilting of the blades 24 relative to the drum 28, this phenomenon being known as "rocking".

Figure 4:
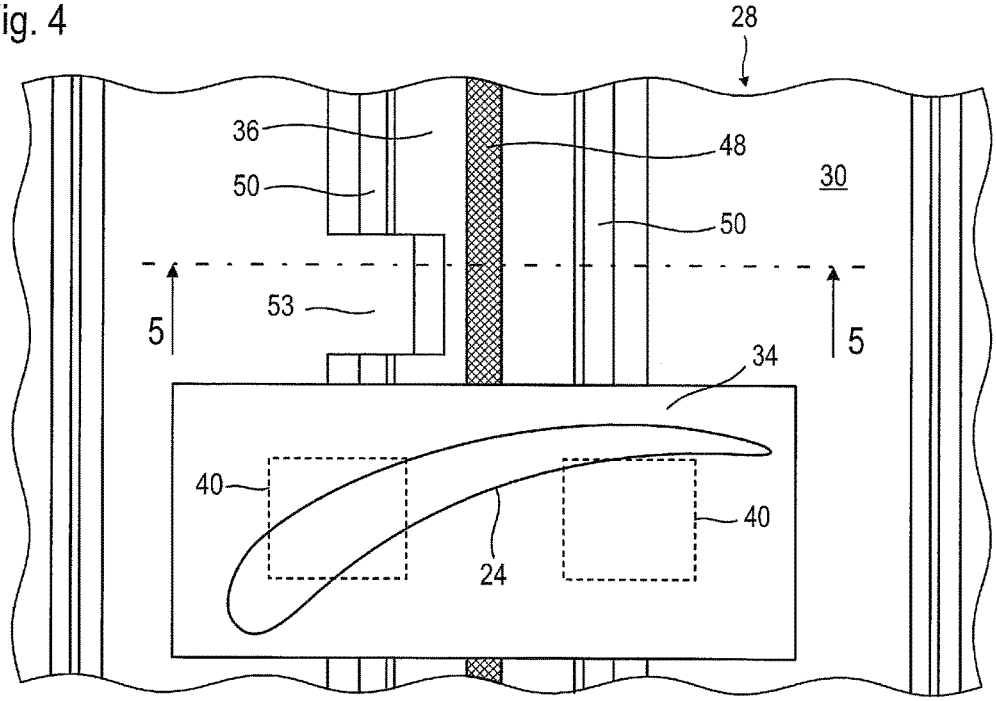
FIG. 4 illustrates a drum in accordance with a first embodiment of the subject application seen radially from above.

FIG. 4 shows the annular body 36 of the drum 28, seen radially from the outside. A rotor blade 24 is mounted on it via its fixing lugs 40.

The annular body 36 has at least one axial notch 53 in one of the retaining surfaces, to be able to fit the rotor blades 24. A latch (not shown) or several latches can close up the notch(es) 53 and may serve to block the blades 24 tangentially. The latches may overlap the annular body 36 or cross it axially. Some rotor blades 24, in particular their platforms 34 or fixing lugs 40 can be modified accordingly.

Figure 5:
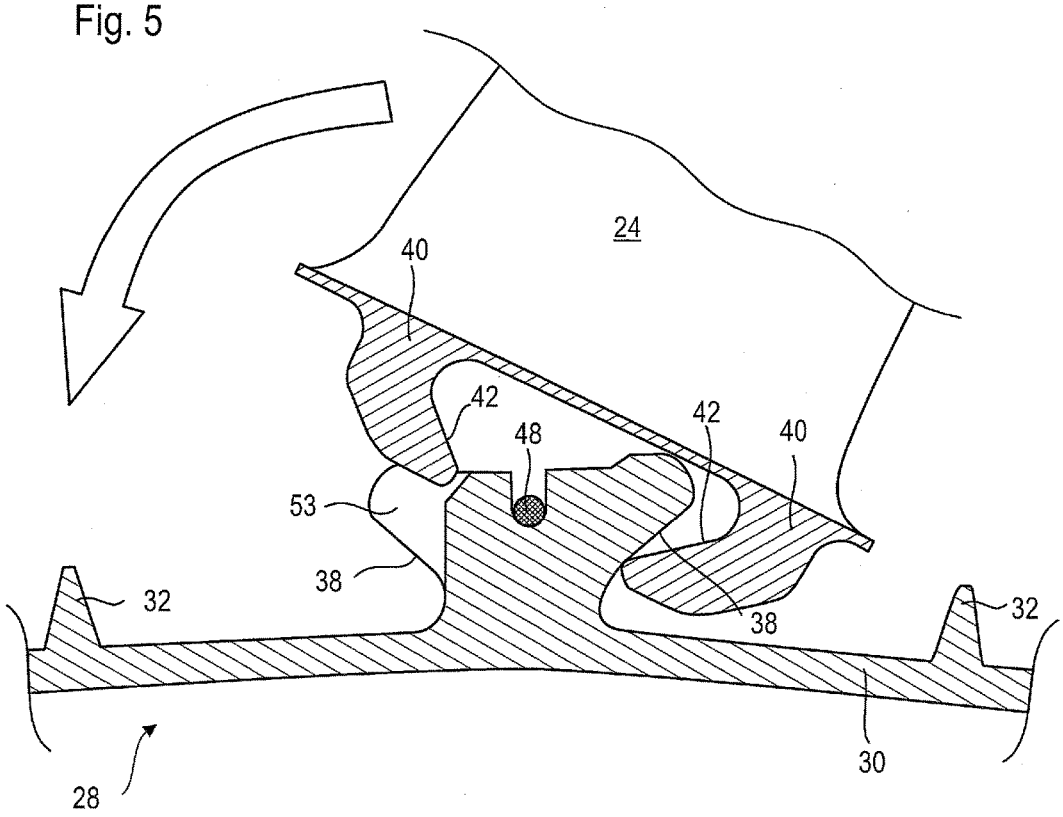
FIG. 5 illustrates the drum in accordance with a first embodiment of the subject application sectioned along 5-5 shown in FIG. 4.

FIG. 5 illustrates a sectional view of the drum in accordance with a first embodiment of the present application, sectioned along 5-5 shown in FIG. 4.

A part or segment of the two annular retaining surfaces may comprise a single blade fixing notch 53 on one of the two retaining surfaces 38, so as to allow the blades 24 to be fixed by a locking movement against the unnotched retaining surface opposite the notch 53, followed by partial insertion of the fixing lug 40 of the platform 34 into the notch 53. The blade 24 can then be slid circumferentially around of the drum, so that its fixing lugs 40 are no longer at the notch(es) 53.

Figure 6:
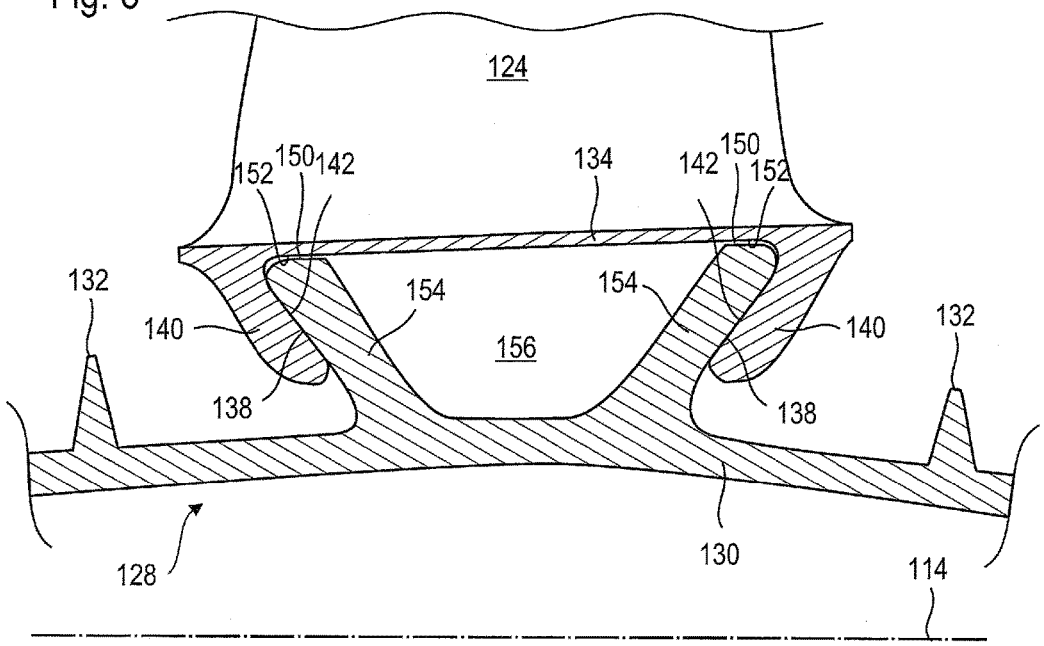
FIG. 6 illustrates a drum in accordance with a second embodiment of the subject application.

FIG. 6 illustrates a rotor in accordance with a second embodiment of the present application. FIG. 6 has the same numbering scheme as in previous figures for the same or similar elements, but the numbering is incremented by 100. Please refer to the descriptions in the preceding figures for similar or equivalent elements. Specific numbers are used for items specific to this embodiment.

The drum 128 comprises two annular flanges 154. The flanges 154 are inclined, preferably relative to each other. They diverge from one another outwards. The profiles have an average length and width. The length is greater than three times the average width, preferably greater than five times. The junctions between the flanges 154 and the wall 130 may be spaced apart from each other. The axial distance between the retaining surfaces measured at the junction with the outer surface of the wall 130 is greater than the average length of the profile of the flanges 154, preferably greater than 1.5 times, more preferably greater than twice. The wall 130 between the flanges 154 may be locally thickened so as to strengthen it.

This configuration allows the retaining surfaces 138 to be axially separated from each other without increasing the weight of the drum 128. The stability of the blade 124 on the drum is improved. Thus, the inclination angles of the profiles of the retaining surfaces 138 and 142 may be selected more freely.

An annular space 156 is defined by the gap between the flanges 154. One of them may have been thickened so as to contain an annular groove and an O-ring designed to provide a seal against the platform of the rotor blade 124. The flanges 154 help to stiffen the drum in a similar way to banding.

The invention claimed is:

1. A turbomachine, comprising:

a low-pressure turbine drum having an axis of rotation; and a wall with a profile of revolution about the axis of rotation of the drum, the wall forming a hollow body;

a plurality of pairs of annular retaining surfaces, each pair being formed by an annular body on an outer surface of the wall;

a plurality of rows of blades, each blade comprising a platform provided with two corresponding retaining surfaces mating with one of the pairs of annular retaining surfaces on the wall;

wherein each pair of retaining surfaces of the drum wall generally diverge from one another to form a profile that widens when going radially outwards from the outer surface of the wall; and wherein at least one of the annular body comprises an annular groove opening radially outwards holding a seal in the shape of a toroid for pressing against platforms of one of the rows of blades, the blades of said row being on said body, by centrifugal force during rotation of the drum.

2. A drum of an axial turbomachine rotor, comprising:

a wall with a profile of revolution about the axis of rotation of the rotor, the wall forming a hollow body;

two annular retaining surfaces formed by an annular body on an outer surface of the wall, the annular retaining surfaces;

a row of blades, each blade comprising a platform provided with two corresponding retaining surfaces mating with the retaining surfaces on the wall;

wherein the two retaining surfaces of the drum wall diverge from one another to form a profile that widens the further the profile is radially outwards from the outer surface of the wall; and wherein the annular body comprises an annular central groove opening radially outwards holding a seal in the shape of a toroid for pressing against platforms of the blades by centrifugal force during rotation of the drum.

3. The drum in accordance with claim 2, wherein the profile of each of the two retaining surfaces forms an average angle of between 30° and 60° with the axis of rotation, and the profiles of the said surfaces form a mean angle between them of between 60° and 120°.

4. The drum in accordance with claim 2, wherein the wall defines the shape of the drum, from a front end thereof to a rear end thereof.

5. The drum in accordance with claim 2, wherein the wall of the drum includes one or more annular ribs upstream and downstream, respectively, of the two retaining surfaces, the ribs being configured to mate with annular abradable layers of material, the wall extending substantially in a straight line along the two retaining surfaces between the upstream and downstream ribs.

6. The drum in accordance with claim 2, wherein the two retaining surfaces are raised radially relative to the adjacent wall.

7. The drum in accordance with claim 2, wherein the wall and the retaining surfaces are made in one piece and formed integrally.

8. The drum in accordance with claim 2, wherein a segment of the two annular retaining surfaces includes a notch for mounting the blades on one of the two surfaces, so as to allow the blades to be assembled by a locking movement of the unnotched retaining surface, followed by tilting a platform to slide into the notch.

9. The drum in accordance with claim 2, wherein the two flanges are located on the wall, separated from one another, such separation being greater than 10 mm.

10. The drum in accordance with claim 2, wherein each blade comprises:

a platform provided with two corresponding retaining surfaces designed to mate with the retaining surfaces of the wall.

11. The drum in accordance with claim 10, wherein the platform comprises:

a cavity open towards the wall of the drum and forming the corresponding retaining surfaces, the bottom of the cavity forming a radial abutment surface directed towards the inside of the drum.

12. The drum in accordance with claim 10, wherein the two corresponding retaining surfaces of the blades are substantially situated in line with the leading and trailing edges, respectively, of the blades.

* * * * *